US008146314B2

(12) United States Patent
Nguyen

(10) Patent No.: US 8,146,314 B2
(45) Date of Patent: Apr. 3, 2012

(54) PREFABRICATED UNIVERSAL STRUCTURAL STEEL PANEL AND PANEL SYSTEM

(76) Inventor: Hung T. Nguyen, Pittsburgh, PA (US)

( * ) Notice: Subject to any disclaimer, the term of this patent is extended or adjusted under 35 U.S.C. 154(b) by 435 days.

(21) Appl. No.: 11/708,570

(22) Filed: Feb. 21, 2007

(65) Prior Publication Data

US 2007/0144090 A1 Jun. 28, 2007

Related U.S. Application Data

(63) Continuation-in-part of application No. 10/947,318, filed on Sep. 23, 2004, now abandoned.

(51) Int. Cl.
*E04B 2/72* (2006.01)
*E04B 2/58* (2006.01)

(52) U.S. Cl. ..... 52/478; 52/474; 52/483.1; 52/276; 52/241; 52/762

(58) Field of Classification Search ..... 52/474, 52/478, 482, 762, 763, 774, 276, 241, 483.1, 52/284, 475.1, 270
See application file for complete search history.

(56) References Cited

U.S. PATENT DOCUMENTS

| | | | | | |
|---|---|---|---|---|---|
| 2,039,293 | A | | 5/1936 | Calkins et al. | 52/376 |
| 3,333,383 | A | | 8/1967 | Raudebaugh, Jr. | 52/508 |
| 3,568,388 | A | | 3/1971 | Flachbarth et al. | 52/588.1 |
| 3,969,866 | A | * | 7/1976 | Kyne | 52/588.1 |
| 4,075,810 | A | | 2/1978 | Zakrzewski et al. | 52/588.1 |
| 4,078,347 | A | | 3/1978 | Eastman et al. | 52/302.3 |
| 4,098,042 | A | | 7/1978 | Sachs et al. | 52/383 |
| 4,155,206 | A | | 5/1979 | Player | 52/200 |
| 4,223,500 | A | | 9/1980 | Clark et al. | |
| 4,267,679 | A | * | 5/1981 | Thompson | 52/588.1 |
| 4,494,348 | A | | 1/1985 | Kastelic | 52/588.1 |
| 4,561,233 | A | * | 12/1985 | Harter et al. | 52/506.1 |
| 4,597,234 | A | * | 7/1986 | Simpson | 52/478 |
| 4,633,634 | A | | 1/1987 | Nemmer et al. | |
| 4,918,898 | A | * | 4/1990 | McLeod, Jr. | 52/588.1 |
| 4,941,304 | A | * | 7/1990 | Lewellin | 52/580 |
| 4,961,295 | A | * | 10/1990 | Kosch et al. | 52/36.5 |
| 5,191,745 | A | | 3/1993 | Story | |
| 5,241,785 | A | * | 9/1993 | Meyer | 52/520 |
| 5,355,649 | A | * | 10/1994 | Berridge | 52/520 |
| 5,425,210 | A | * | 6/1995 | Zafir | 52/404.4 |
| D363,997 | S | | 11/1995 | Nomura | |
| 5,483,778 | A | | 1/1996 | Scrivener | |
| 5,490,361 | A | | 2/1996 | Gingras | |
| 5,678,369 | A | * | 10/1997 | Ishikawa et al. | 52/309.9 |

(Continued)

FOREIGN PATENT DOCUMENTS

FR 2 547 335 A1 12/1984

(Continued)

*Primary Examiner* — Phi Dieu Tran A
(74) *Attorney, Agent, or Firm* — Richard C. Litman

(57) ABSTRACT

The prefabricated universal structural steel panel and panel system includes a generally elongated rectangular panel having an opposed exterior and interior surfaces, an opposed first and second end portions, and an opposed first and second side edge portions. At least two stiffening ribs are integrally formed in the panel and extend longitudinally between the first and second end portions. The first side edge portion has a beveled configuration and is integrally connected to an elongated male connecting member. An elongated female connecting member is integrally connected to the second side edge portion and extends adjacent the interior surface to define a fold. The elongated male connecting member of one panel is cooperatively profiled to mate with the female connecting member of an adjacent panel.

17 Claims, 18 Drawing Sheets

U.S. PATENT DOCUMENTS

| | | | | |
|---|---|---|---|---|
| 5,699,644 | A | 12/1997 | Smith | |
| 5,743,056 | A | 4/1998 | Balla-Goddard et al. | |
| 5,752,355 | A | 5/1998 | Sahramaa | |
| 5,911,663 | A * | 6/1999 | Eidson | 52/520 |
| 5,927,028 | A * | 7/1999 | Rossi | 52/202 |
| 6,134,855 | A | 10/2000 | Beck | |
| 6,421,972 | B1 | 7/2002 | Dalphond et al. | |
| D464,738 | S | 10/2002 | Wall | |
| 6,493,995 | B2 | 12/2002 | McKenzie | |
| 6,568,144 | B2 * | 5/2003 | Meredith | 52/656.1 |
| 6,655,095 | B1 | 12/2003 | Pingel | |
| 7,104,020 | B1 * | 9/2006 | Suttle | 52/551 |
| 2002/0069600 | A1 | 6/2002 | Bryant | |
| 2003/0230038 | A1 | 12/2003 | Seavy | |
| 2004/0040239 | A1 | 3/2004 | Baillargeon | |
| 2004/0045238 | A1 | 3/2004 | Dunn et al. | |
| 2004/0123555 | A1 | 7/2004 | Cole | |
| 2004/0128928 | A1 | 7/2004 | Stagner | |

FOREIGN PATENT DOCUMENTS

| | | | |
|---|---|---|---|
| GB | 2049008 | 12/1980 | 52/588.1 |
| JP | 4-131458 | 5/1992 | |
| JP | 4-289362 | 10/1992 | 52/588.1 |

* cited by examiner

PREFABRICATED UNIVERSAL STRUCTURAL STEEL PANEL AND PANEL SYSTEM

CROSS REFERENCE TO RELATED APPLICATION

This application is a continuation-in-part of U.S. application Ser. No. 10/947,318 filed Sep. 23, 2004 now abandoned.

BACKGROUND OF THE INVENTION

1. Field of the Invention

The present invention relates generally to prefabricated steel panel, and in particular to a prefabricated universal structural steel panel and panel system for constructing a building.

2. Description of the Related Art

The concept of prefabricated steel panels has a long history with numerous areas of application, including the construction industry. Typically, prefabricated steel panels are employed for commercial application, such as prefabricated steel buildings. While some prefabricated steel panels are adaptable to be joined together to form an exterior wall panel, floor panel or roof panel, these panels are limited to a fixed range of application. However, if a given prefabricated steel panel is capable of performing a greater number of functions it is potentially able to increase cost and labor savings. In addition, a prefabricated universal steel panel that is capable of a range of applications, such as internal walls, ceilings, exterior walls, floors, and roofs could lower the over cost of constructing the building, such as a home, which potentially could be beneficial to the home buyer. Furthermore, a prefabricated universal steel panel that incorporates the structural components required to build a building structure can reduce construction waste.

Accordingly, there is a need for a prefabricated universal structural steel panel, which is capable of application to virtually all aspects of a given construction while retaining a suitable level of versatility for constructing a variety of building components, such as interior and exterior walls, ceilings, floors, and roofs. Additionally, there is a need for a prefabricated universal structural steel panel, which is suitable for domestic and commercial application and utilizes a minimal amount of material. Furthermore, there is a need for a steel panel system that connects the prefabricated steel panels in a manner, which forms a structural component of the building. Thus, a universal structural steel panel and panel system solving the aforementioned problems is desired.

SUMMARY OF THE INVENTION

The prefabricated universal structural steel panel and steel panel system for constructing a building includes a generally elongated rectangular panel having an opposed exterior and interior surfaces, an opposed first and second end portions, and an opposed first and second side edge portions. The first side edge portion is designed and configured with a beveled or tapered side edge portion, which has an elongated male connecting member integrally connected thereof and extending away from the interior surface. An elongated female connecting member is integrally connected to the second side edge portion and extends away from the interior surface. At least two stiffening ribs are integrally formed and embedded in the panel and extend longitudinally between first and second end portions.

The elongated male and female connecting members are in substantially complementary mating relationship with respect to each other, such that when elongated male connecting member of one universal structural steel panel is slidably interlocked with the elongated female connecting member of an adjacent universal structural steel panel the two panels are joined in a substantially continuous plane.

Advantageously, the prefabricated universal structural steel panel system provides an efficient method to erect the shell of residential houses or commercial buildings, including the walls, roof, ceiling, and sub-floor. Additionally, the prefabricated universal structural steel panels have a generally uniform configuration, which is adaptable for a variety of applications.

These and other advantages of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
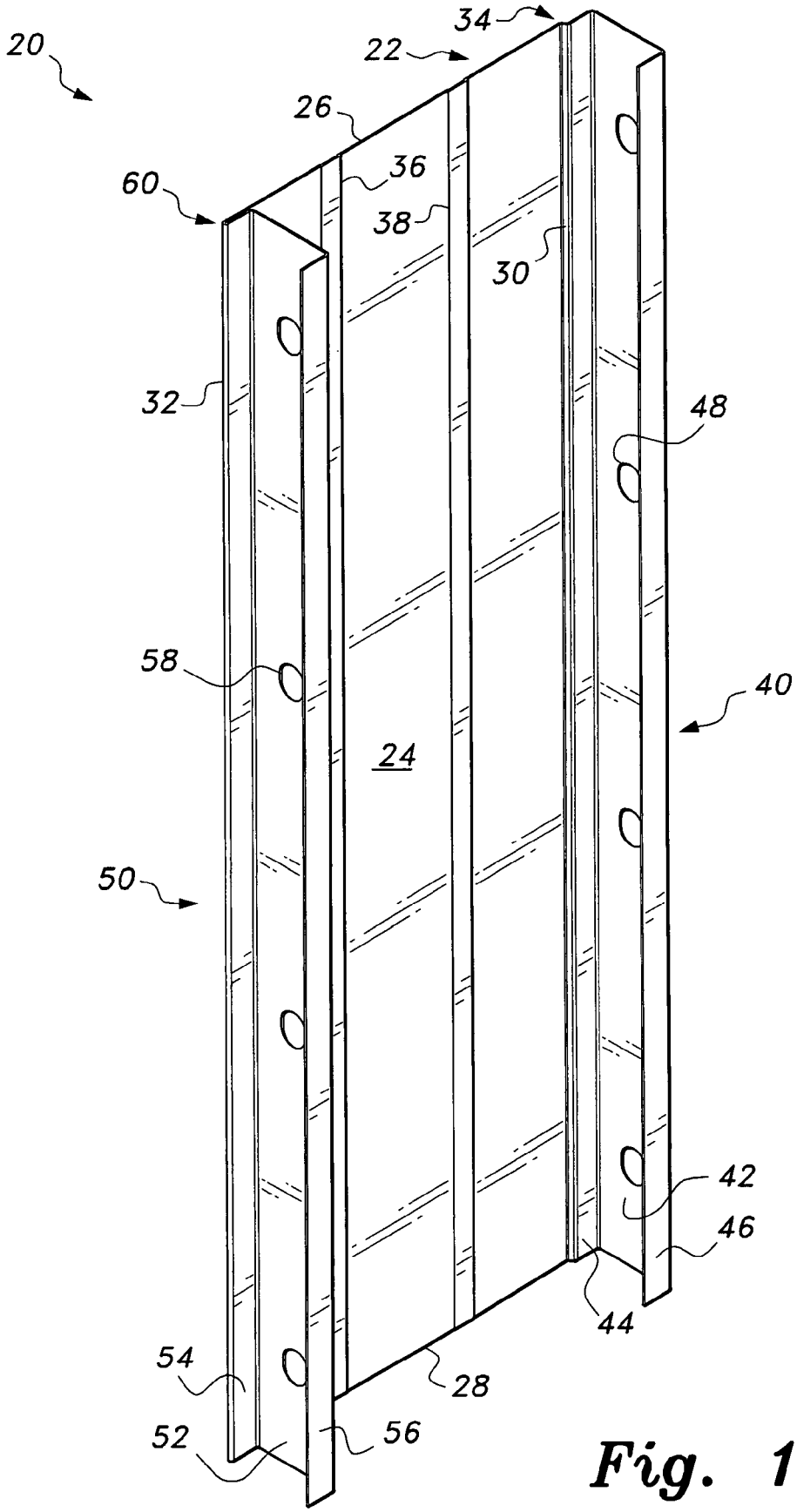
FIG. 1A is a perspective view of a prefabricated universal structural steel panel according to the present invention.
Figure 1B:
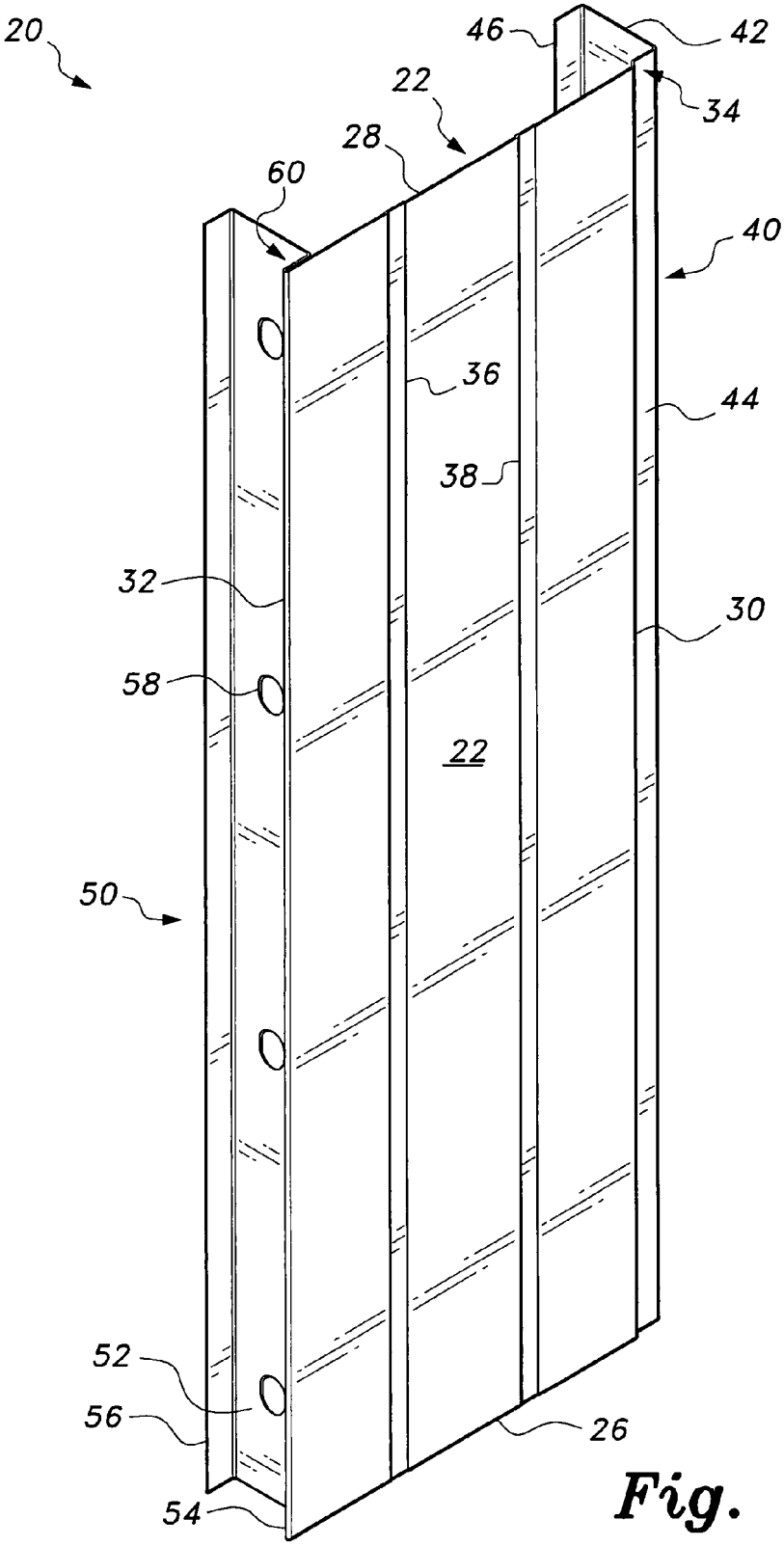
FIG. 1B is a perspective view of a prefabricated universal structural steel panel according to the present invention.
Figure 1C:
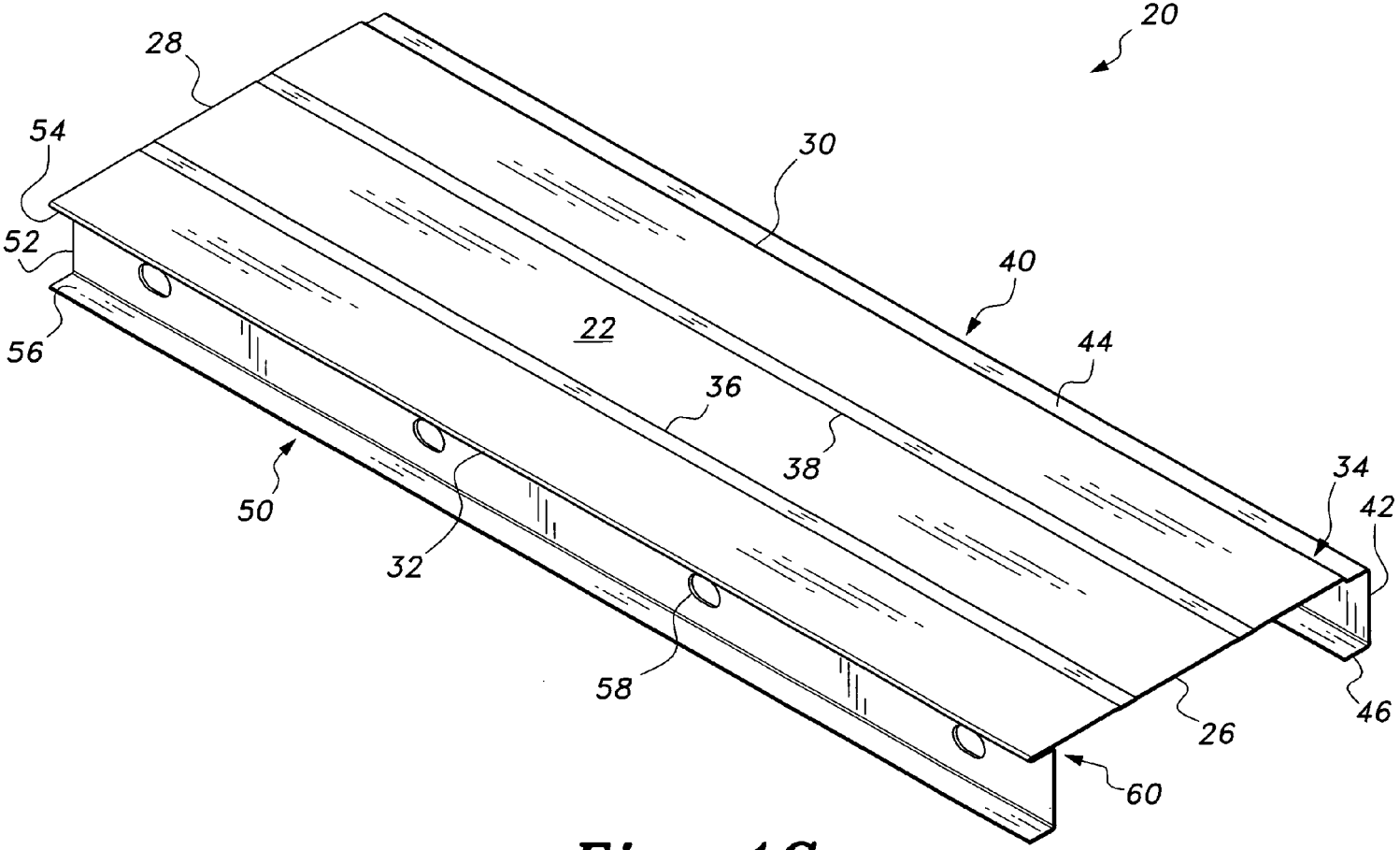
FIG. 1C is a perspective view of a prefabricated universal structural steel panel according to the present invention.
Figure 2:
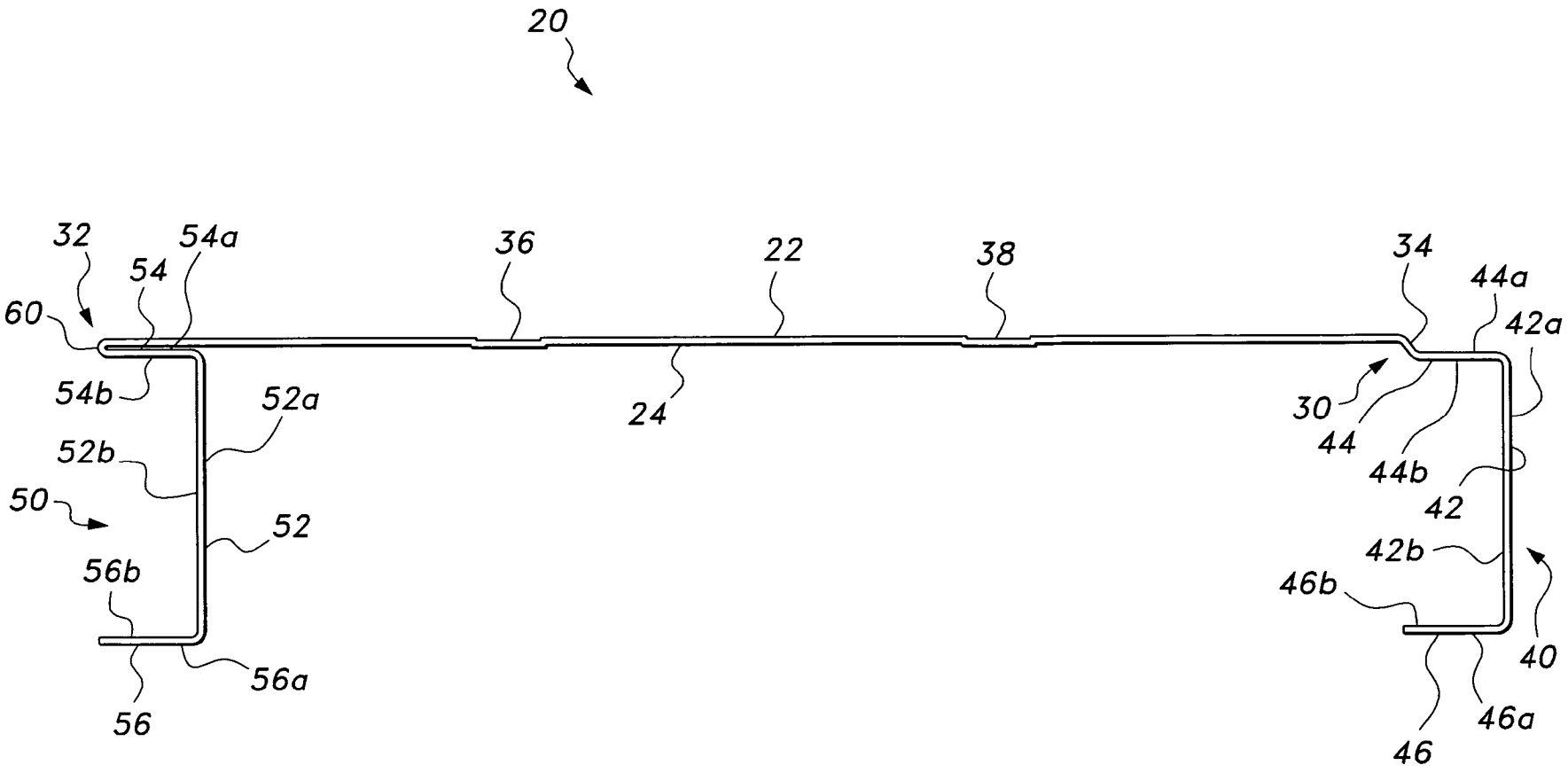
FIG. 2 is an end view of a prefabricated universal structural steel panel according to the present invention.

Turning to the drawings, FIGS. 1A, 1B, 1C, and 2, show a preferred embodiment of a prefabricated universal structural steel panel 20, in accordance with the present invention. Generally, the universal structural steel panel 20 includes a generally elongated rectangular panel having an opposed exterior and interior surfaces 22, 24, an opposed first and second end portions 26, 28, and an opposed first and second side edge portions 30, 32. The first side edge portion 30 is designed and configured with a beveled or tapered side edge portion 34. In addition, the panel 20 includes stiffening ribs 36 and 38, which are integrally formed and embedded to the panel 20 and extend longitudinally from first and second end portions 26, 28. Although the preferred embodiment of the panel 20 is substantially rectangular shape, the panel 20 can be fabricated in a variety of different shapes. For example, the panel 20 can be a substantially square, oblong or trapezoidal shape.

An elongated male connecting member 40 is integrally connected to the first side edge portion 30 and extends away from the interior surface 24. The elongated male connecting member 40 defines a support member, such as a beam, having a generally U-shape or C-shape configuration. The elongated male connecting member 40 includes a web 42 and a first and second legs 44, 46 extending from opposite sides thereof. The first and second legs 44, 46 are in a generally parallel orientation with each other and have substantially similar length and width. The end portion of the first leg 44 is integrally connected to the beveled or tapered side edge portion 34 of the first side edge portion 30.

An elongated female connecting member 50 is integrally connected to the second side edge portion 32 and extends away from the interior surface 24. The elongated female connecting member 50 defines a support member, such as a beam, having a generally U-shape or C-shape configuration. The elongated female connecting member 50 includes a web 52 and a first and second legs 54, 56 extending from opposite sides thereof. The first and second legs 54, 56 are in a generally parallel orientation with each other and have substantially similar length and width. The end portion of the first leg 54 is integrally connected to second side edge portion 32 and extends adjacent to the interior surface 24 to define a fold 60 thereof. The fold 60 has a width and length that is generally similar to the width and length of the first leg 54.

The webs 42 and 52 have an outer face 42*a*, 52*a* and an inner face 42*b*, 52*b*, respectively, and a plurality of apertures 48, 58 extending through the outer and inner faces 42*a*, 52*a*, and 42*b*, 52*b*. When the elongated male connecting member 40 of one panel 20 is slidably interlock with the elongated female connecting member 50 of adjacent panel 20, the apertures 48 and 58 are in alignment with respect to each other to define utility passageways for utility services, such as electrical wiring, heating and ventilation pipes/conduits, and plumbing, to pass through the adjoined panels 20.

Preferably, the elongated male and female connecting members 40, 50 are formed from rolling the elongated rectangular panel 20 through rollers. More preferably, the panel 20 is prefabricated from a sheet of steel 222 by a roll form machine 216, which has rollers 224 designed and configured to form the elongated male and female connecting members 40 and 50, respectively, as describe further below. The steel used to fabricate the panel 20 can be of any type of steel. Preferably, the prefabricate universal structural steel panel 20 is galvanized steel.

Figure 3A:
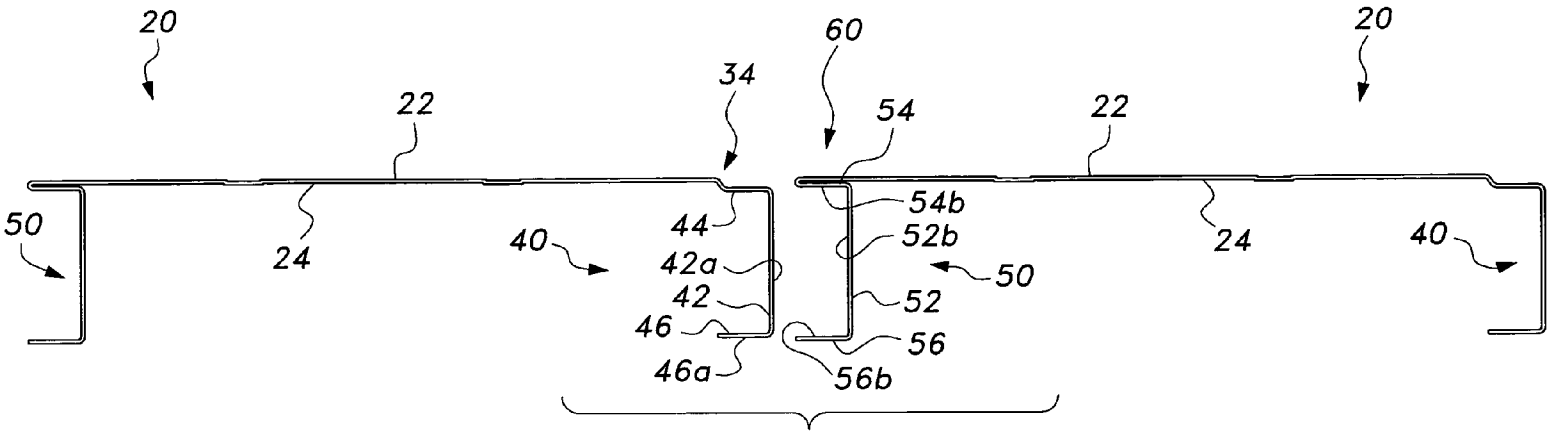
FIGS. 3A and 3B is a top view of a prefabricated universal structural steel panel according to the present invention showing the panels being assembled.
Figure 3B:
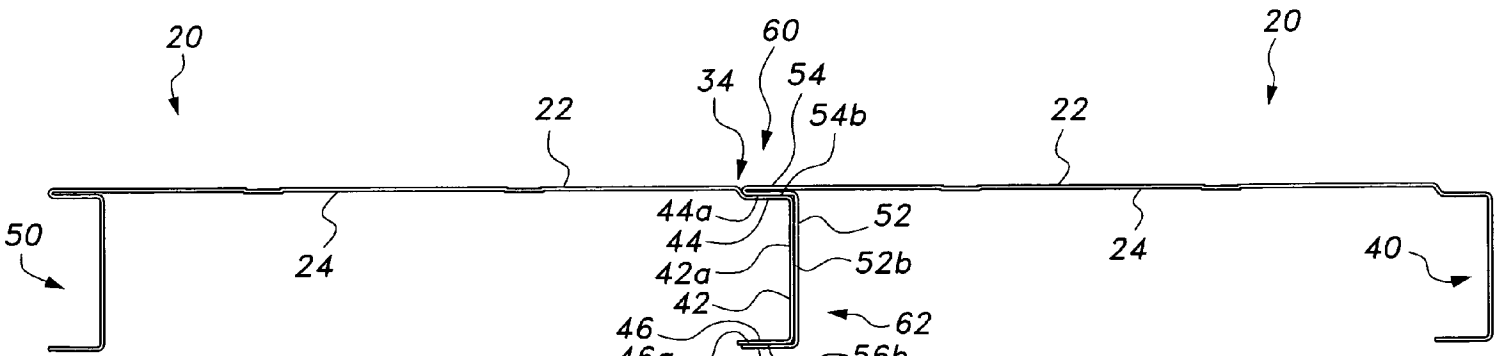

Referring to FIGS. 3A and 3B, the elongated male connecting member 40 of panel 20 is cooperatively profile to mate with the elongated female connecting member 50 of adjacent panel 20. The elongated male connecting member 40 is slidably interlocked into the elongate female connecting member 50 so that the outer face portion 42*a* of web 42 is in abutting relationship with inner face portion 52*b* of web 52 and the outer face portions 44*a*, 46*a* of legs 44, 46 are in abutting relationship with the inner face portions 54*b*, 56*b* of legs 54, 56, respectively. The adjoined elongated male and female connecting members 40 and 50 further define a support member, such as, for example, a load-bearing beam.

The outer face portion 44*a* of the first leg 44 is offset relative to the exterior surface 22 so that when the end portion of the first female leg 54 is adjacent to the bevel or taper 34 side edge portion, the exterior surfaces 22 of the adjoined panels 20 are relatively flush with respect to each other in a substantially continuous plane.

Figure 4:
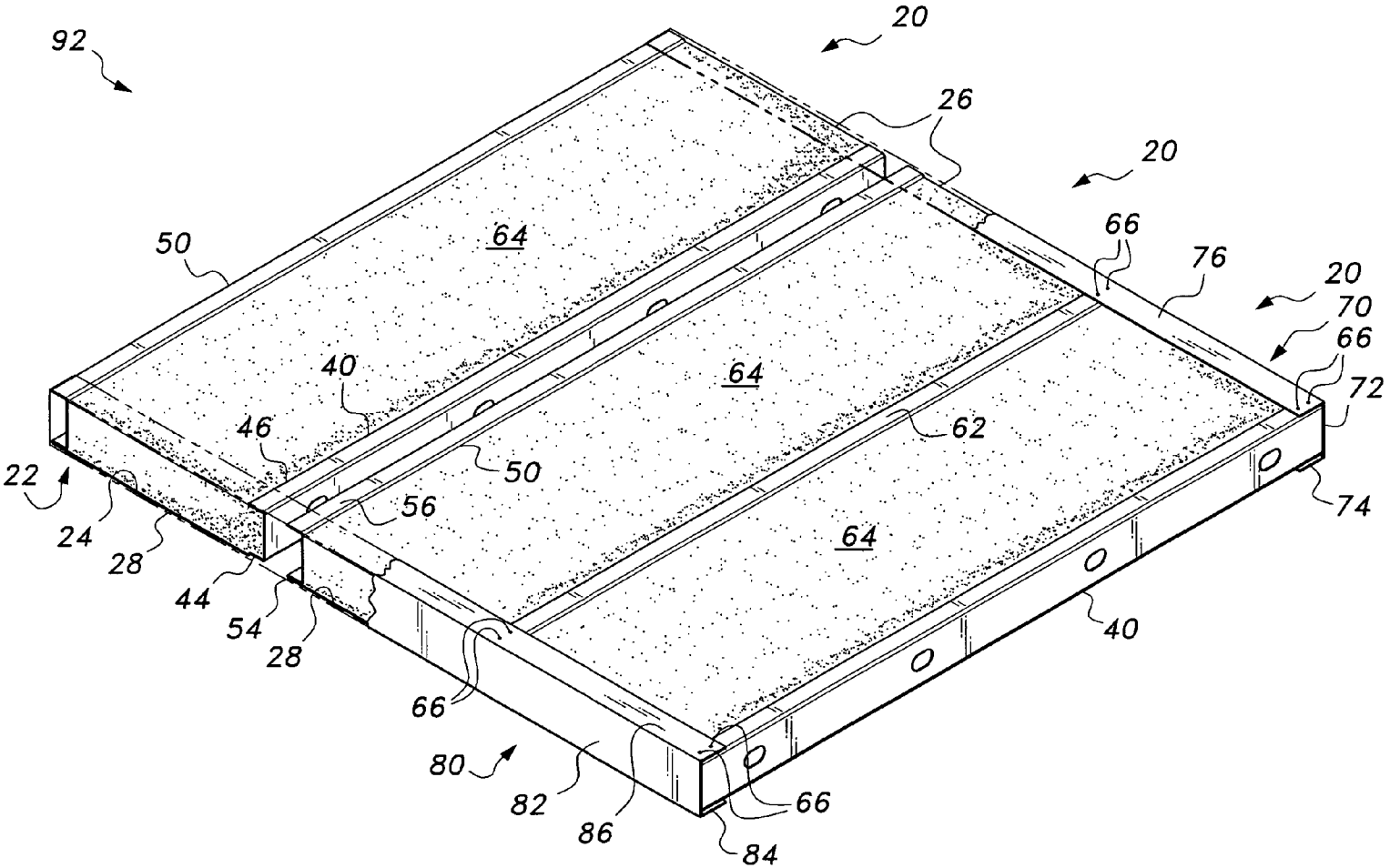
FIG. 4 is a partial exploded view of a plurality of universal steel panels being assembled to form a building structure, such as a wall structure, according to the present invention.

FIG. 4 shows the universal structural steel panels 20 being assembled to form a building shell 90, in accordance with the present invention. As illustrated, a plurality of panels 20 are slidably interlocked and joined with each other to construct a building component 92. The building component 92 can be the walls, floor, ceiling, and roof of the building shell 90, as described below.

The building component 92 is constructed in the following manner. The elongated male connecting member 40 of panel 20 is in complementary mating relationship with elongated female connecting member 50 of the adjacent panel 20. The elongated male and female connecting members 40, 50 are positioned in substantially parallel relationship with each other, so that when elongated male connecting member 40 slidably interlocks to the elongated female connecting member 50 of the adjacent panel 20, the panels 20 are joined in a substantially side edge-to-side edge and co-planer orientation.

A first connecting member 70 and second connecting member 80 are positioned in substantially parallel relationship with respect to each other and are joined to the first and second end portions 26, 28, respectively, by a plurality of fasteners 66. Thereafter, the adjacent panel 20 is positioned in mating relationship relative to the new panel 20, which is being installed. The foregoing procedure is followed until a desired length and width of the wall, roof, ceiling and/or floor is constructed. For example, if an 8-foot long wall is desired, then six panels 20 can be joined and interlocked together to form the 8-foot long wall section.

After the panels 20 have been assembled an optional step is to insulate the wall, floor, ceiling, or roof section with an injection of insulation material, such as a high density Class 1 isofoam polyisocyanate, also known as polyurethane insulation material. The insulation is injected into the panels 20 and adheres to all interior surfaces therein. Advantageously, the injection of the insulation material into the panels 20 increases the rigidity of the building component 92.

Additionally, once the universal structural steel panels 20 are joined together, a plurality of fasteners 66 can be used to further secure the panels 20 to each other. The fasteners 66 can be screws, threaded fasteners with nuts attached thereon, or rivets or, alternatively, the panels can be spot welded or bonded together by an adhesive. Furthermore, when fasteners 66 are used to secure the elongated male connecting member 40 to the elongated female connecting member 50, the fasteners 66 are attached at the center portion of the webs 42 and 52.

For example, the fasteners 66 could be generally spaced apart at an equal distance from each other along the longitudinal centerline of the interlocked panels 20. Alternatively, the prefabricated universal structural steel panels 20 can be permanently attached thereto by generally spaced spot-welds or any other suitable connecting method, which is in compliance with the Uniform Building Code of the area where the building is being constructed.

As illustrated further in FIG. 4, the first and second connecting members 70, 80 are generally oriented in a parallel configuration with respect to each and with longitudinal lengths similar to the length of the assembled panels 20, so that the opposing end portions of the first and second connecting members 70, 80 are relatively flush with the end sections of the assembled panels 20. Fasteners 66 are used to join the first and second connecting members 70, 80 to the first and second end portions 26, 28, respectively, to form a generally rectangular building component 92.

The first and second connecting members 70, 80 are generally U-shape members having a web portions and first and second legs, which have substantially similar widths and lengths. Preferably, the first and second connecting members 70, 80 are U-shaped steel members. When the first and second connecting members 70, 80 are employed as part of a wall component, the first and second connecting members 70, 80 define hat channels. Alternatively, the first and second connecting members 70, 80 can be a generally C-shape metal member.

The first and second connecting members 70, 80 each include a web 72, 82 and first and second legs 76, 86 and 74, 84, respectively, extending outwardly from opposite sides of the web 72 and 82. The first and second legs 76, 86 and 74, 84, are oriented in a generally parallel configuration with respect to each other and are substantially equal in length and width, such that the first and second legs 76, 86 and 74, 84, are generally the same dimension. The first and second connecting members 70 and 80 are configured so that the webs 72 and 82 abut the first and second end portions 26, 28 of the panels 20. The first and second end portions 26, 28 are received between the legs 74, 76 of the first connecting member 70 and the legs 84, 86 of the second connecting member 80.

With the universal prefabricated structural steel panels 20 and the first and second connecting members 70, 80 in place as described, the first and second legs 44, 54 and 46, 56 of the elongated male and female connecting members 40, 50 are joined to the respective first and second legs 76, 86 and 74, 84 of the first and second connecting members 70, 80. With this, the building component 92 is rigidly formed.

The joining method used to join the panels 20 and the first and second connecting members 70, 80 certainly could be accomplished in a number of ways that would occur to one skilled in the art. For example, the panels 20 and the first and second connecting members 70, 80 could be joined by spot welding, by fasteners, such as metal screws, bolts and nuts, rivets, by clinching methods, or by adhesive.

Figure 5:
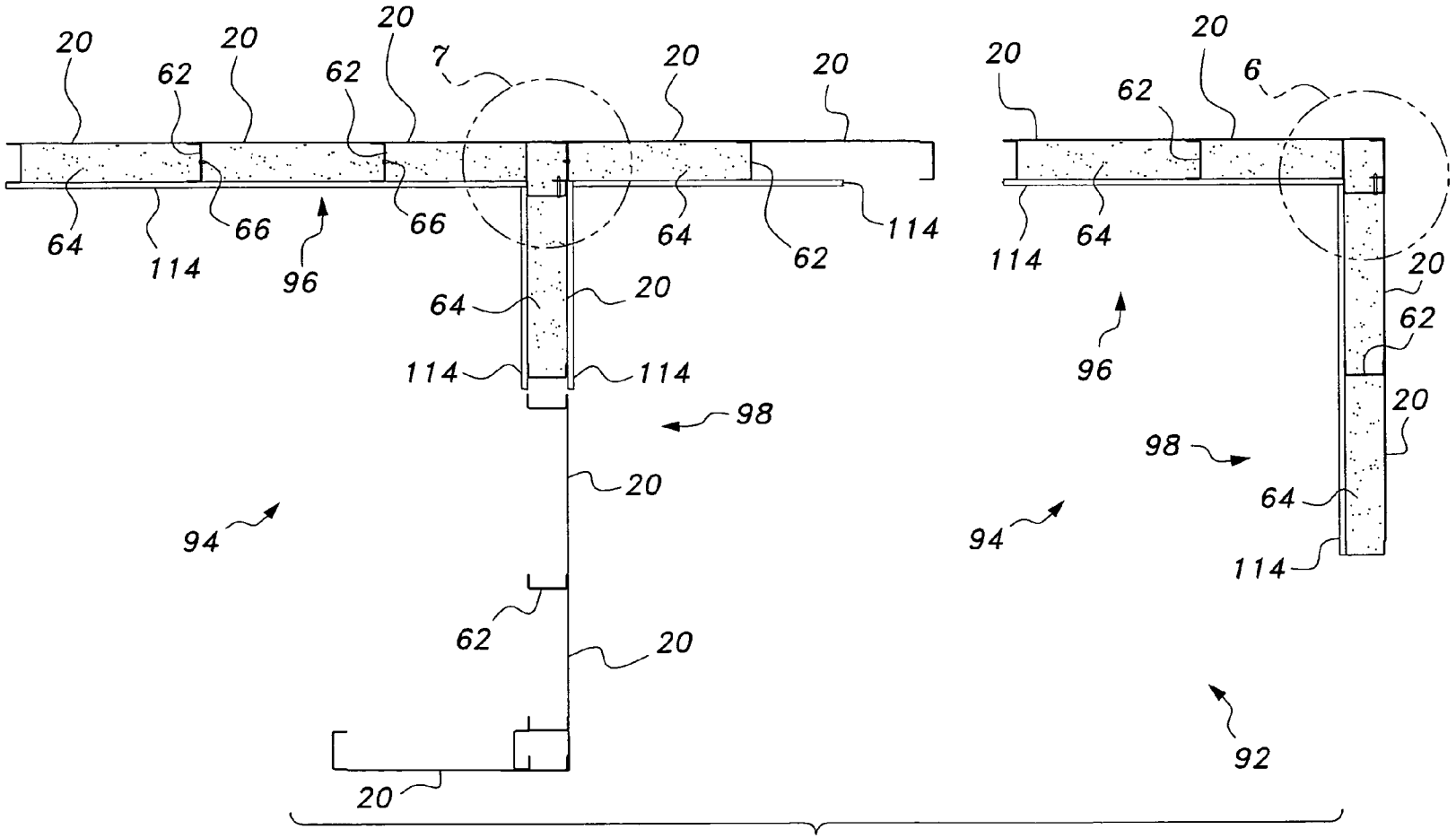
FIG. 5 is a partial top view of a wall structured formed from a plurality of universal steel panels with insulating material according to the present invention.

FIG. 5 illustrates a stage of construction where the panels 20 are being assembled to form a wall component 94 according to the panel system of the present invention. The wall component 94 is constructed from the universal structural panels 20, as described above. In this arrangement, the universal structural steel panels 20 define wall panels 20.

The first connecting member 70 is not shown in order to provide a view of the various panel connections within the walls 96, 98. The walls 96, 98 are constructed by interlocking the panels 20, as described above. Two typical wall configurations are depicted. The first configuration is a typical perpendicular wall connection where first wall 96 is joined to second wall 98 to form a typical exterior wall to interior wall component of a building. However, a typical interior wall to interior wall component can be formed by this arrangement. The second configuration is a typical corner wall connection where first wall 96 is joined to second wall 98 to form an exterior wall component. However, an interior wall component can be formed by this arrangement.

Figure 6:
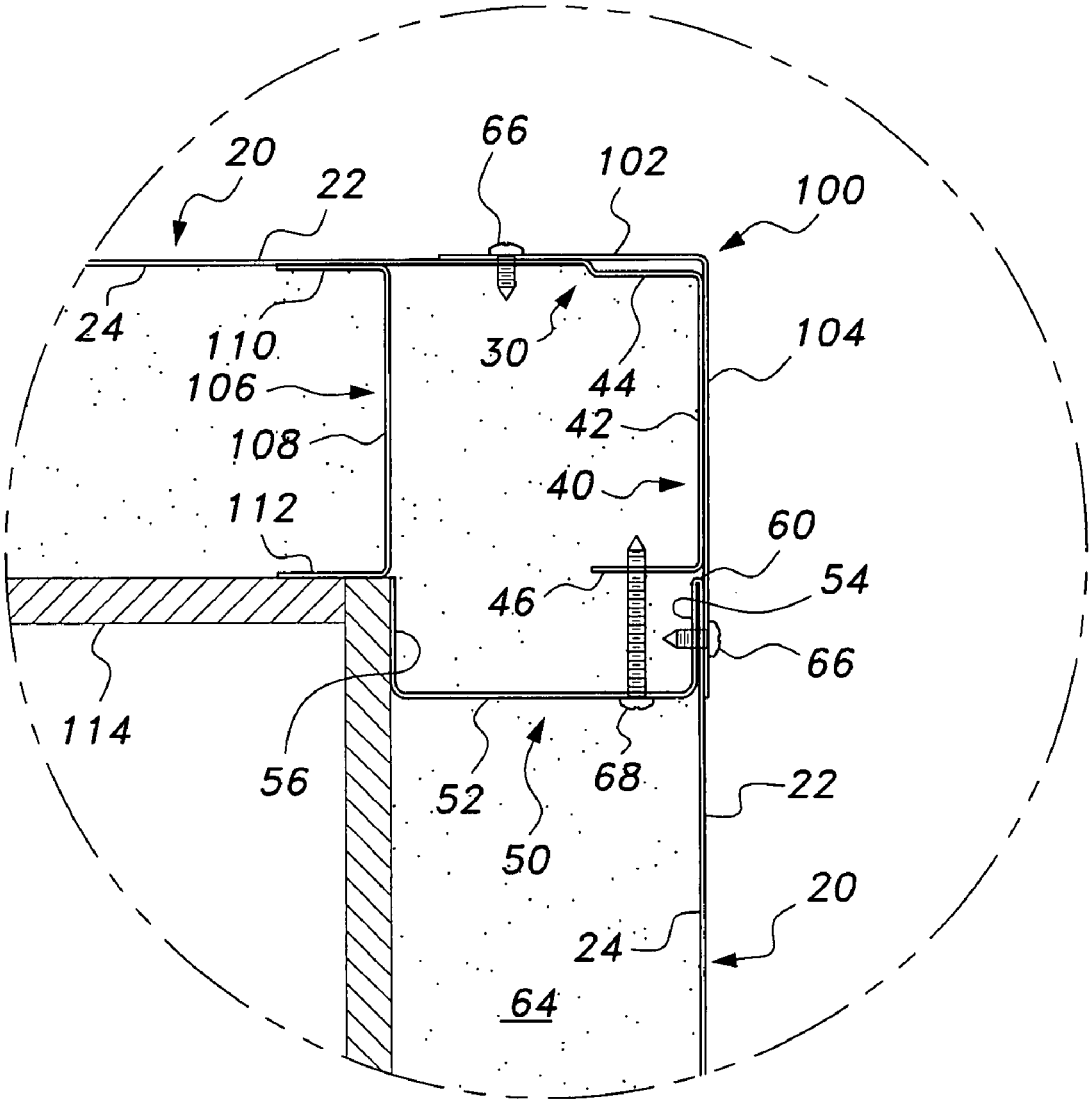
FIG. 6 is a detail view of FIG. 5, showing a corner wall connection according to the present invention.

FIG. 6 shows further detail of a typical corner wall connection. At this corner connection, two conventional panels 20, as described above, are used. The two panels 20 are positioned adjacent to each other so that an end portion of first leg 54 of the elongated female connecting member abuts the outer face 46*a* of second leg 46 of the elongated male connecting member. The web 50 of elongated female connecting member is joined to the second leg 46 of elongated male connecting member by fastener 68, which can be a plurality of fasteners.

A corner member 100 is positioned adjacent to the exterior surfaces 22 of the two panels 20 to form the corner wall component. The corner member 100 has a first leg 102 and second leg 104 that are integrally connected together and extend at approximately a 90 degree angle thereof to define a generally L-shape corner member 100. The L-shape corner member 100 is joined to exterior surfaces 22 of panel 20 of the first wall 96 and panel 20 of second wall 98 by fasteners 66, which can be a plurality of fasteners 66. The L-shape corner member 100 is preferably steel. More preferably, the L-shape corner member 100 is galvanized steel.

A reinforcing support member 106 is disposed adjacent to the panels 20 for providing support to walls 96, 98 and for mounting gypsum board 114 or other suitable materials thereon. The reinforcing support member 106 has a web 108 and a first and second legs 110, 112 extending from opposite sides thereof. The first and second legs 110, 112 are in a generally parallel configuration with respect to each other. When the reinforcing support member 106 is employed as part of the wall component 94, the reinforcing support member 106 defines a stud having a generally U-shape configuration. Alternatively, the reinforcing support member 106 could define a stud having a generally C-shape configuration with a first and second flanges integrally connected to the end portions of first and second legs 110, 112, respectively, and extending inwardly thereof.

The reinforcing support member 106 is positioned inside wall 96 with the first leg 110 adjacent to the interior surface 24 of panel 20. The second leg 112 of reinforcing support member 106 is adjacent to the second leg 56 of elongated female connecting member 50. The second legs 56, 108 are arranged in orientation with respect to each other in a relatively 90 degree angle, such that second legs 56, 108 define an interior corner wall surface for mounting gypsum board 114 thereon. Insulation 64 is disposed inside wall 96, 98 between the gypsum board 114 and interior surface 24 of the panels 20. The reinforcing support member 106 is preferably a steel stud, which is welded or fastened to the panels 20. More preferably, the reinforcing support member 106 is galvanized steel.

Figure 7:
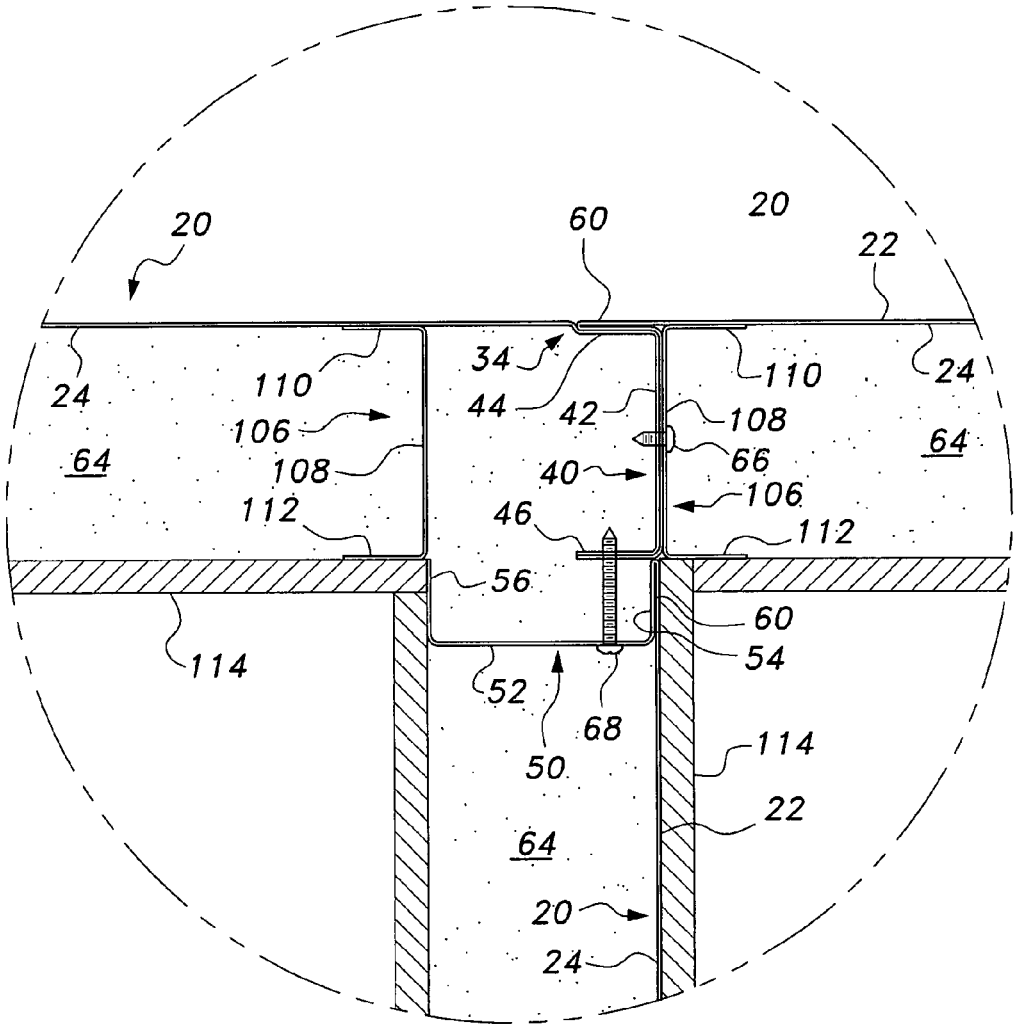
FIG. 7 is a detail view of FIG. 5, showing a perpendicular wall connection according to the present invention.

FIG. 7 shows further detail of a typical perpendicular wall connection. At this perpendicular connection, three conventional panels 20, as described above, are used. The two panels 20 form part of first wall 96 and are interlocked with each other, as described above. A first reinforcing structural member 106 is positioned adjacent to elongated female connecting member 50, so that web 52 abuts web 108. A fastener or a plurality of fasteners 66 are used to join the reinforcing support member 106 to load-bearing support member 62, which is formed by the elongated male connecting member 40 being adjoined to the elongated female connecting member 50.

A second reinforcing support member 106 is positioned inside wall 96 with the first leg 110 adjacent to the interior surface 24 of panel 20. The second leg 112 of reinforcing support member 106 is adjacent to the second leg 56 of elongated female connecting member 50, which forms part of second wall 98. The second legs 56, 108 are orientated in a relatively 90-degree angle with respect to each other, so that second legs 56, 108 define an interior corner wall surface for mounting gypsum board 114 thereon. Insulation 64 is disposed inside walls 96, 98 between the gypsum board 114 and interior surface 24 of the panels 20.

One knowledgeable in the art will be aware that a plurality of fasteners 66 and 68 can be used to secure the panels 20 and connecting wall components together, as illustrated in FIGS. 6 and 7. Additionally, the fasteners 66 and 68 used to secure the first wall 96 to the second wall 98 can be screws, bolts and nuts, or rivets. Alternatively, the panels 20 and connecting wall components can be secured by any conventional method, such as, spot welding or an adhesive.

Figure 8:
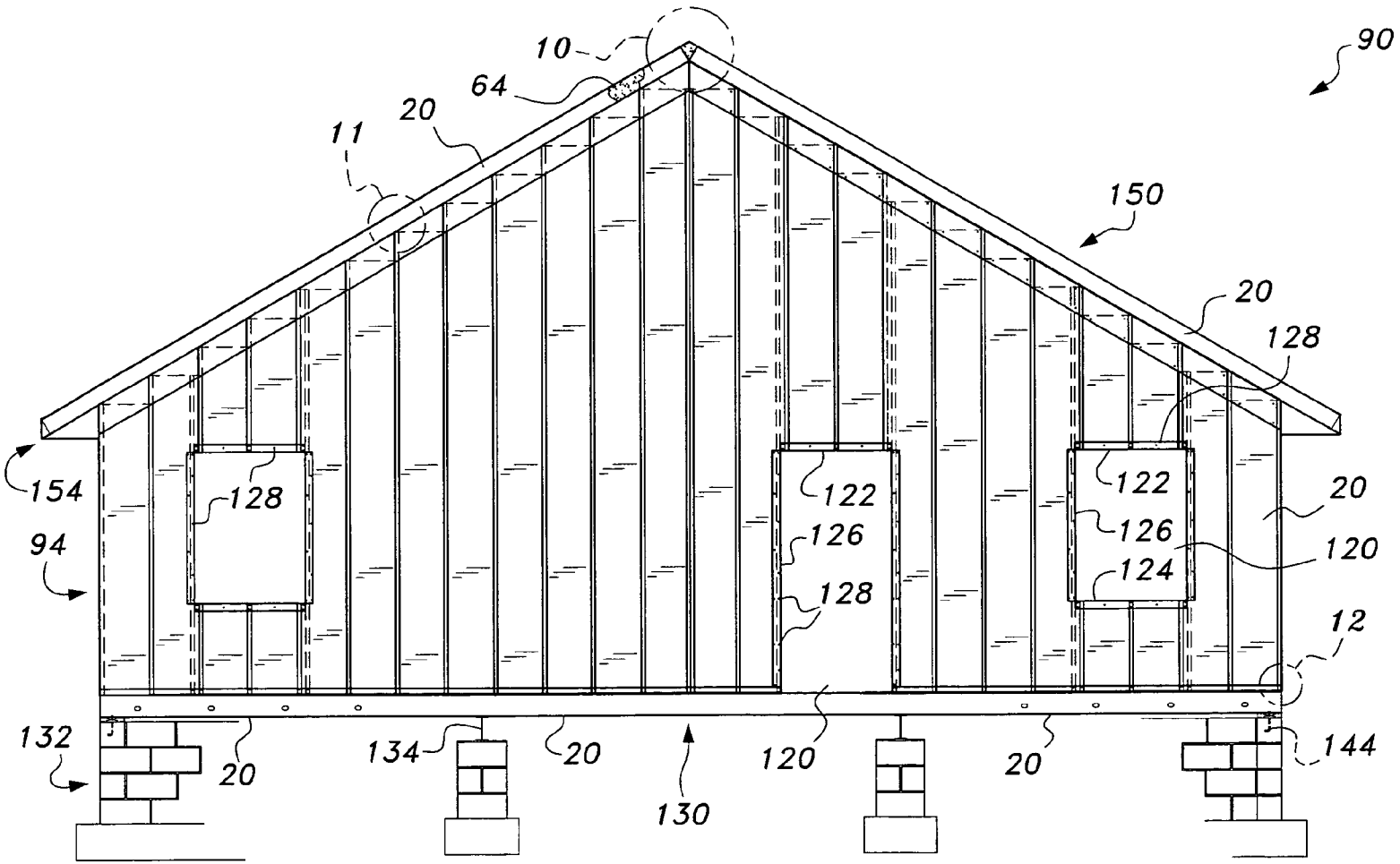
FIG. 8 is a side elevational view of a building structure formed form a plurality of universal steel panels according to the present invention.
Figure 9:
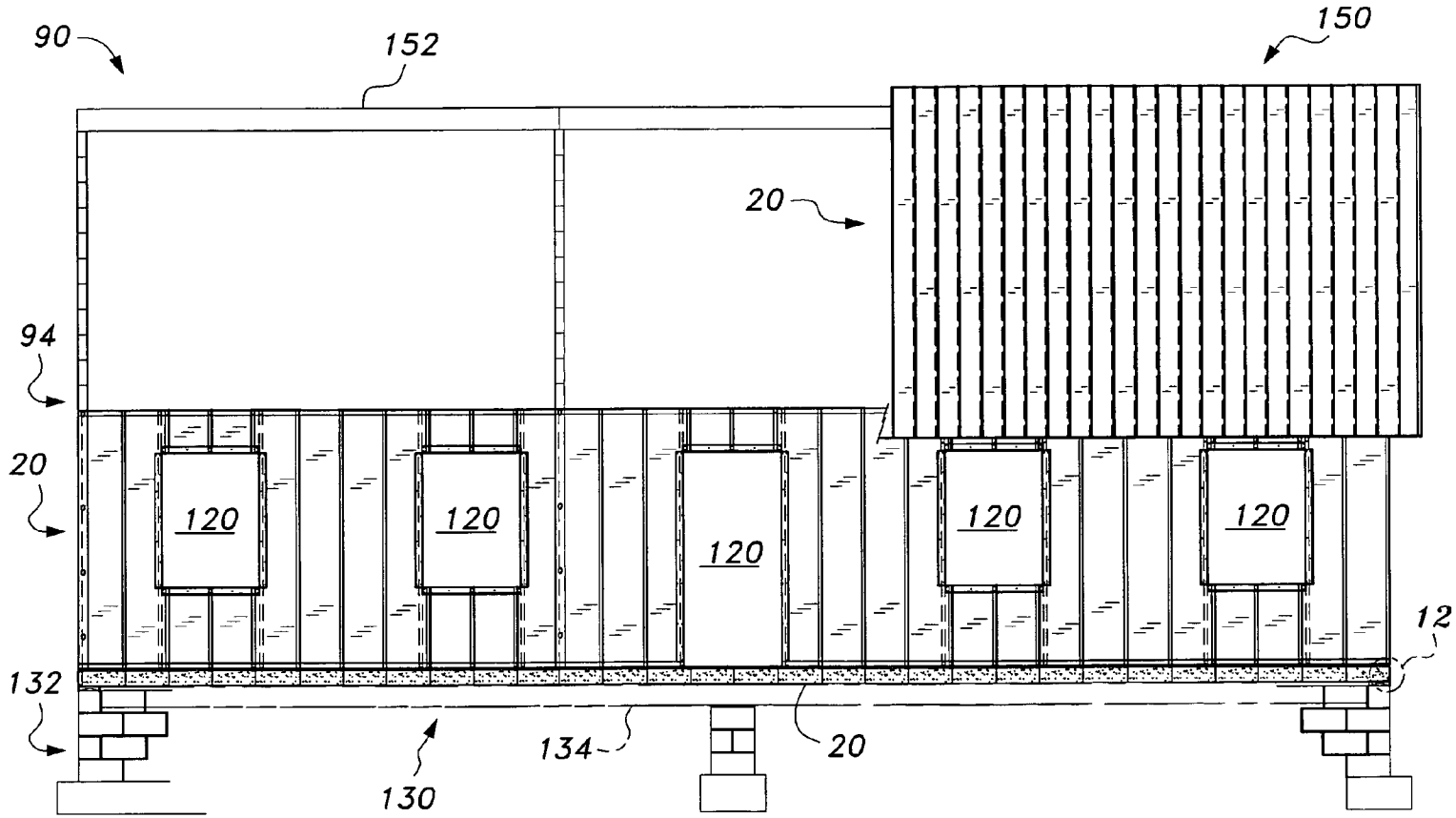
FIG. 9 is a front elevational view of a building structure formed form a plurality of universal steel panels according to the present invention.

Referring to FIGS. 8 and 9, the universal structural steel panels 20 are assembled to construct a building 90 pursuant to the panel system of the present invention. The building 90 can be residential or commercial and can be single story or multilevel.

As can be appreciated by one skill in the art, the universal structural steel panels 20 can be adapted to carry different structural load requirements of the building 90. Accordingly, the thickness of the sheet of steel used to fabricate the panels 20 can be increased or decreased to satisfy the various load requirements of the wall component 94, roof component 150, and floor component 130, which are joined together to form the building 90.

Additionally, the panels 20 can be constructed and arranged to fit within each other to increase the overall thickness of the universal structural steel panel. For example, a second panel 20 can be inserted inside a first panel 20 to double the thickness of the first panel 20. Similarly, a second and third panel 20 can be inserted inside a first panel 20 to treble the thickness of the first panel 20.

As described above, the universal structural steel panels are joined together to construct the building component 92, which are the floor 130, the wall 94, and the roof and ceiling 150 of a building shell 90. Accordingly, the floor 130, the wall 94, and the roof and ceiling 150 include a plurality of panels 20 joined to each other by interlocking the elongated male connecting member 40 of one panel 20 with the elongated female connecting member 50 of adjacent panel 20. The first and second connecting members 70, 80 are connected to the first and second end portions 26, 28, respectively, of the interlocked panels 20 to construct the building component 94 (as illustrated in FIG. 4), which forms a generally rectangular building component. The building components 94 define the floor 130, roof and ceiling 150, and wall 94 components.

The floor components 130 are connected to each other side-by-side and end-to-end to construct the floor 130. In this configuration, the universal structural steel panels 20 define floor panels 20. The floor panels 20 are positioned on the foundation so that the exterior surfaces 22 face in an upwardly direction to receive a sub-floor sheathing. The sub-floor sheathing is connected to the exterior surfaces 22 by conventional construction methods.

As described above, the load-bearing support member 62 is defined by the elongated male connecting member 40 being interlock to the elongated female connecting member 50. When the panels are joined together in an arrangement to form the floor 130, the load-bearing support members 62 define floor trusses. The legs 46 and 54 of elongated male and female connecting members 40 and 50 are positioned adjacent to the foundation 132 and the I-Beam 134.

The load-bearing support members 62 and legs 46 and 54 of elongated male and female connecting members 40 and 50, respectively, are attached to the foundation 132 and I-beams 134 by conventional construction methods, such as anchor bolts 144. Preferably, ½-inch diameter anchor bolts 144 are used to secure the floor 130 to the foundation 132. Although a foundation wall is illustrated in FIGS. 8 and 9, the panels 20 can be attached to any type of foundation, such as a concrete slab, basement wall, columns, I-beams, or any other foundation used to support the building 90.

The wall components 94 are constructed as described above. The wall components 94 are assembled with a predetermined number of openings 120 for the placement of fixtures, such as doors and windows. The window and door openings 120 include headers 122, jambs 126, and sills 124, which form the door and window frames. The wall components 94 are connected to each other side-by-side with second connecting member connected to floor 130 and first connecting member 70 connected to the roof 150. Alternatively, first connecting member 70 can be connected to a ceiling, which is defined by a second floor 130 of a multi-story or multi-level building 90. When the building 90 includes multiple stories/levels, wall 94 of a second story is stacked on top of wall 94 of the first level with a second floor 130 disposed between the first story wall and the second story wall.

Similar to the floor 130, when the panels 20 are joined to form the roof 150, the load-bearing support members 62 define roof trusses. The roof components 150 are connected to each other side-by-side and end-to-end to construct the roof 150. In this configuration, the universal structural steel panels 20 define roof panels 20. The roof panels 20 are connected to the wall components 94 to form the building 90. A facia cap 154 extends around the exterior perimeter of the roof 150.

Figure 10:
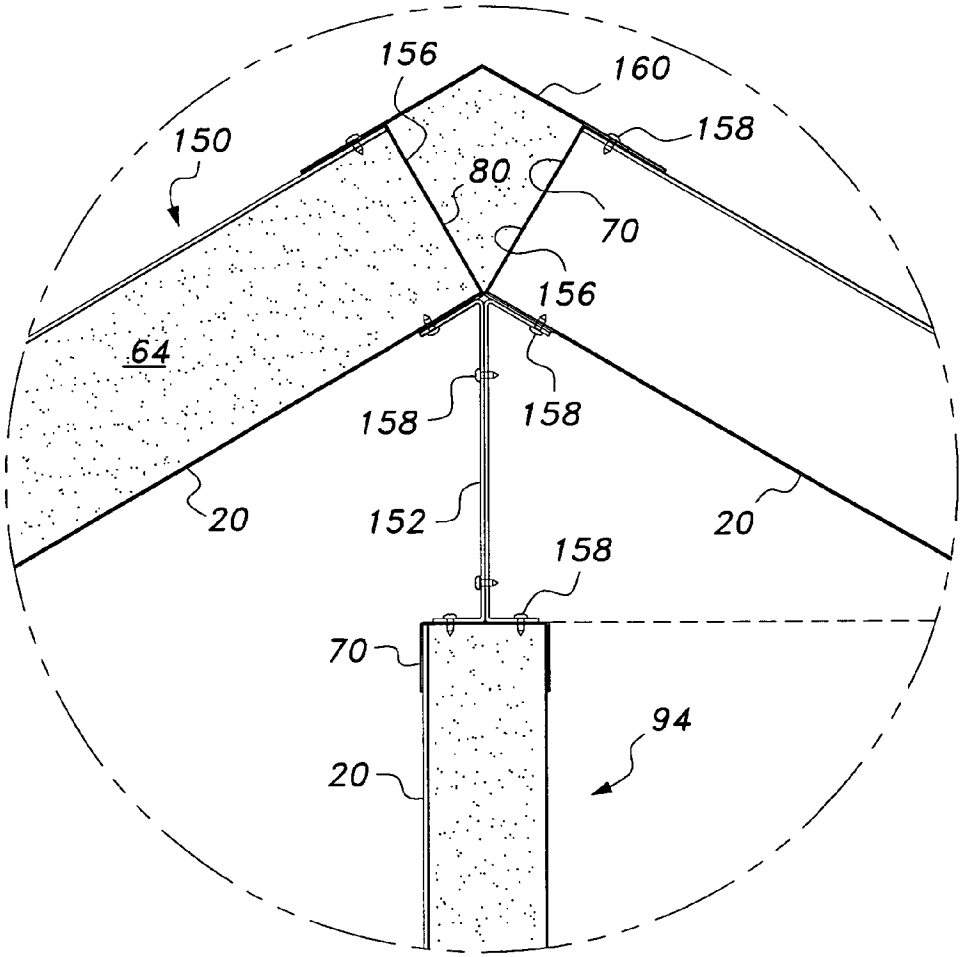
FIG. 10 is a detail view of FIG. 8, showing a roof and wall connection according to the present invention.

FIG. 10 shows the roof 150 joined to the wall 94 by a ridge beam 152. The ridge beam 152 is formed from two substantially similar pieces, which are fastened together by fasteners 158. The fasteners 158 can be screws, bolts and nuts, or rivets. Alternatively, the two pieces of the ridge beam 152 could be welded together. The ridge beam 152 is fastened to the first connecting member 70, which defines the top hat channel of the wall 94, by fasteners 158.

A first roof panel 20 is positioned on top of the first piece of the ridge beam 152 and a second roof panel 20 is positioned on second piece of the ridge beam 152 so that first and second connecting members 70, 80 are adjacent to each other. The first and second connecting members 70, 80 define roof tracks 156. A ridge cap 160 is connected to the exterior surfaces 22 of the adjacent roof panels 20 by fasteners 158. Insulation 64 is disposed inside the roof 150 and the wall 94.

Figure 11:
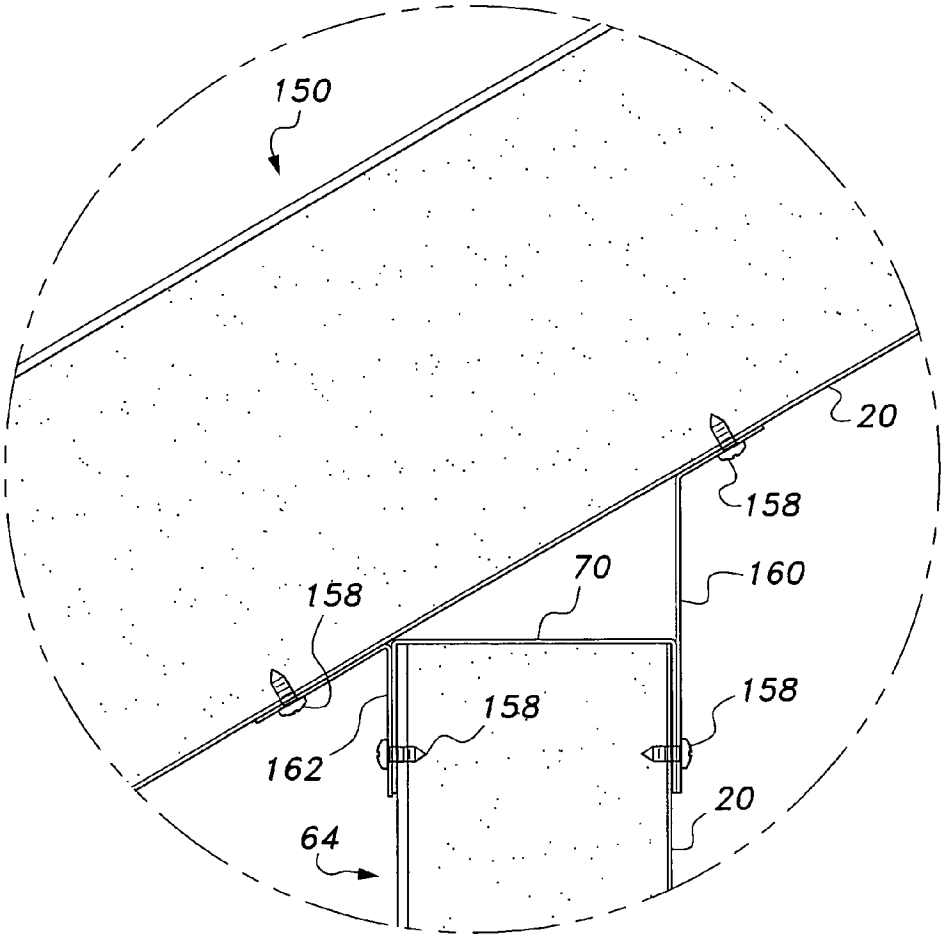
FIG. 11 is a detail view of FIG. 8, showing a roof and wall connection according to the present invention.

FIG. 11 shows the roof 150 joined to the wall 94 by two connecting brackets 160, 162. Bracket 162 is substantially V-shaped and bracket 160 is substantially L-shaped with one leg portion extending at an angle relative to the other leg portion. The brackets 160, 162 are positioned on opposite sides of wall 94. Brackets 160 and 162 are connected to the roof panel 20 and to wall 64 by fasteners 158, such as screws, bolts and nuts, rivets or, alternatively, by spot welding or an adhesive.

Figure 12:
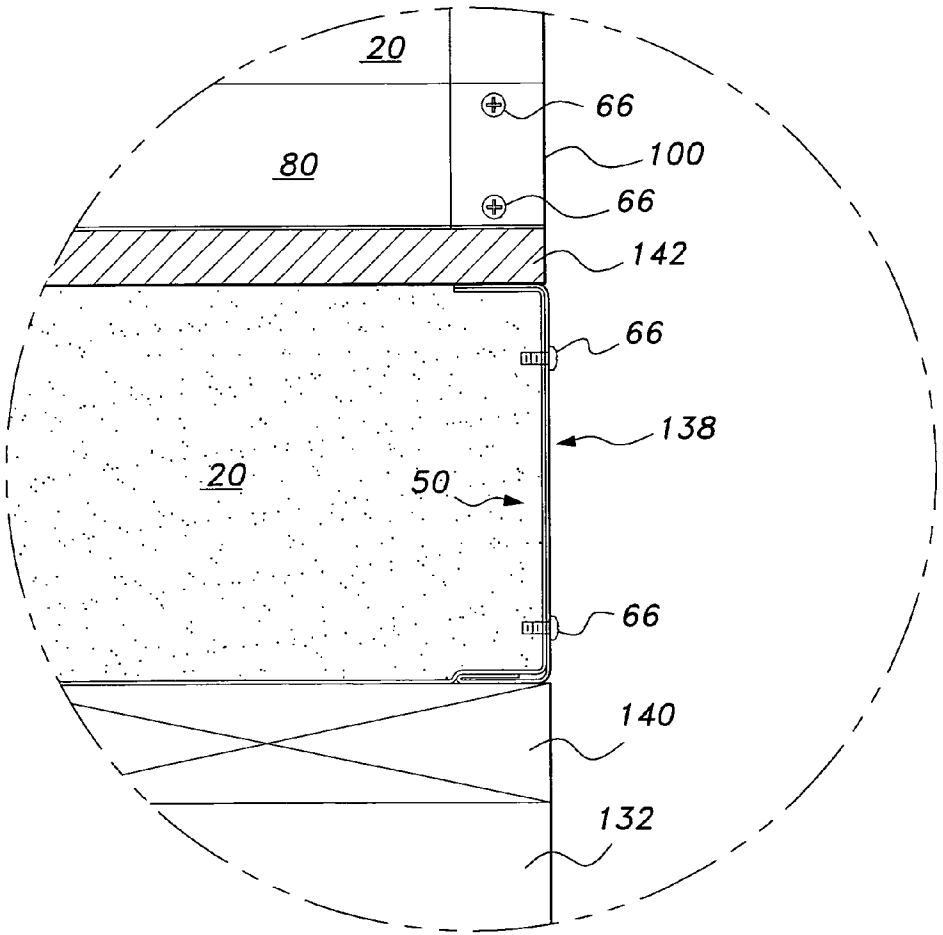
FIG. 12 is a detail view of FIG. 9, showing a wall, floor, and foundation connection according to the present invention.

FIG. 12 shows further detail of the connection between the wall 94, the floor 130 and the foundation 132. The wall panel 20 is connected to the sub-floor sheathing 142 by conventional construction joining methods, such as anchor bolts, nails, adhesives, glue, or screws. Similarly, the floor panels are joined to the sub-floor sheathing 142 and to the wood sill 140 by conventional construction joining methods, such as anchor bolts, glue, adhesives, nails, or screws. The wood sill 140 is anchored to the foundation 132.

In more detail, the second connecting member 80 defines a hat channel, which is anchored to the sub-floor sheathing 142. The corner member 100 is connected to the exterior surface of the panel 20 and the second connecting member 80 by fasteners 66. A floor paneling cap 138, which is defined by first or second connecting members 70, 80 is cooperatively profiled to mate with elongated female connecting member 50. Fasteners 66 secure the floor-paneling cap 138 to the panels 20.

Figure 13A:
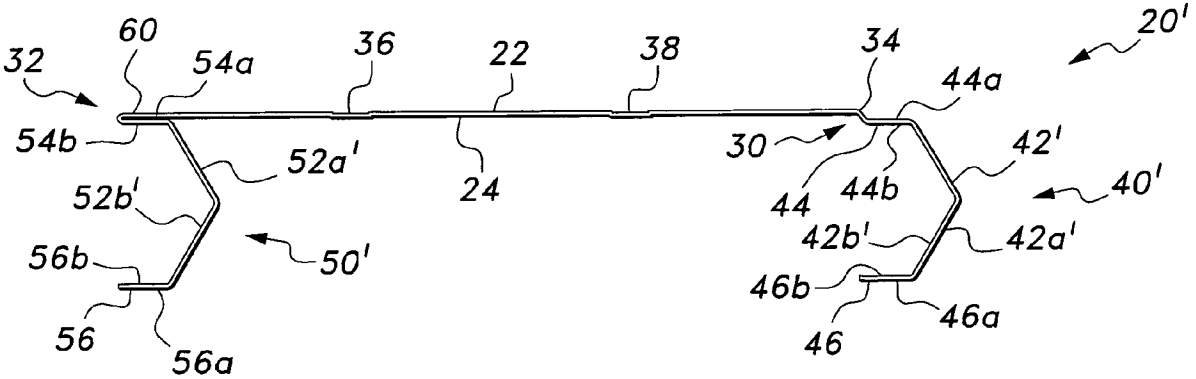
FIGS. 13A and 13B is a top view of a prefabricated universal structural steel panel according to the present invention showing a second embodiment.
Figure 13B:
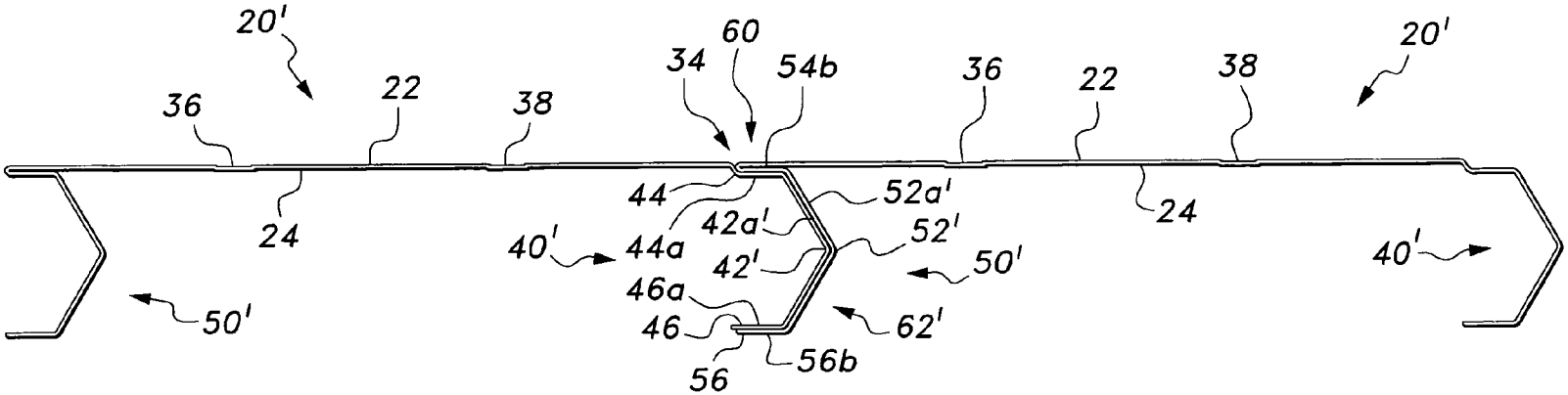

FIGS. 13A and 13B depict a second embodiment of the invention that is substantially identical to the above-described embodiment of the universal structural steel panel 20 except that elongated male and female connecting members 40, 50 have a different configuration. As described above, elongated male and female connecting members 40, 50 are cooperatively profiled to mate with each other so that the universal structural steel panels 20' are joined together in a substantially continuous plane with the exterior surfaces 22 being generally flush with each other. As shown in FIG. 13A, elongated male connecting member 40' includes a web 42' having a generally V-shape configuration. First and second legs 44, 46 are integrally connected to opposite end portions of the V-shaped web 42' and extend outwardly thereof in a substantially parallel relationship to each other.

Similarly, elongated female connecting member 50' includes a web 52*a'* having a generally V-shape configuration with first and second legs 54, 56 integrally connected to opposite end portions and extending outwardly thereof in a substantially parallel relationship to each other. Legs 54 and 44 are integrally connected to first and second side edge portions 30 and 32, respectively. When elongated male connecting member 40' of panel 20' is slidably received into elongated female connecting 50' of adjacent panel 20', as shown in FIG. 13B, the panels 20' interlock with each other to form a portion of the building 90, such as the wall, roof, or floor component.

Figure 14:
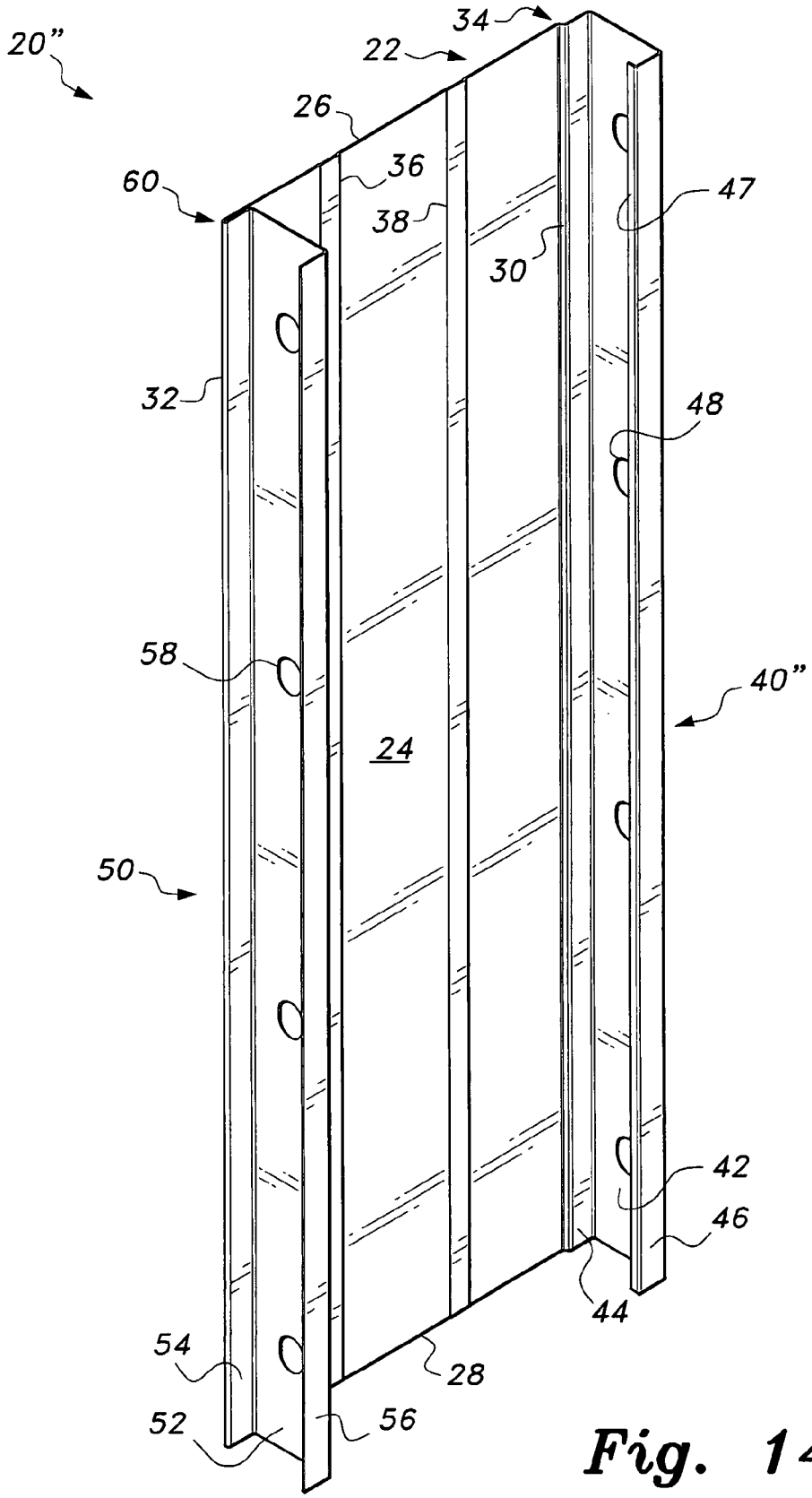
FIG. 14 is a perspective view of a prefabricated universal structural steel panel according to the present invention showing a third embodiment.
Figure 15A:
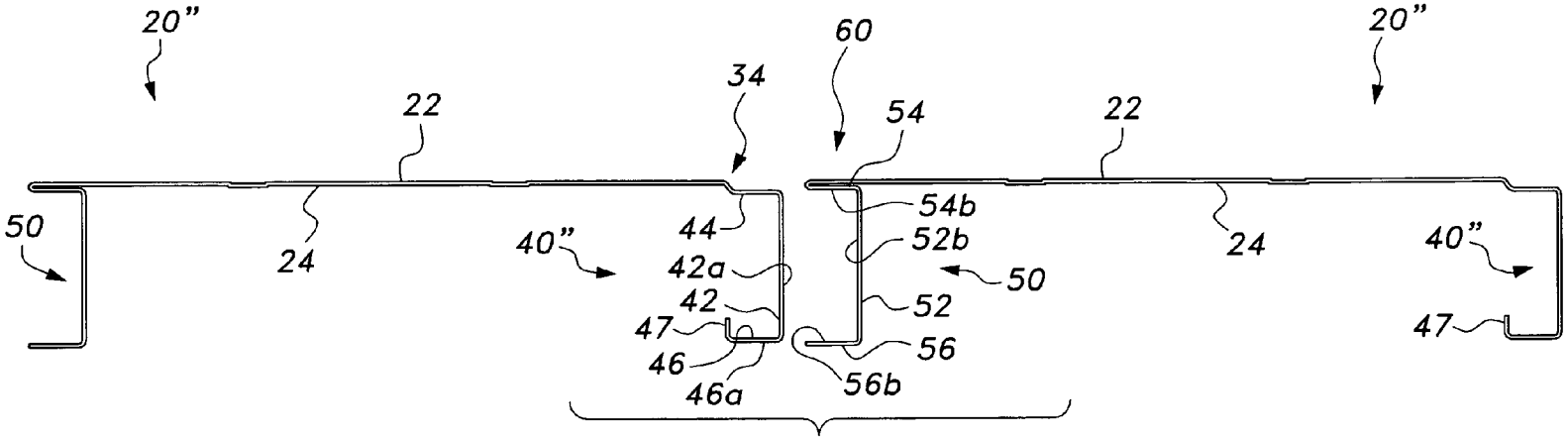
FIGS. 15A and 15B is a top view of a prefabricated universal structural steel panel according to the present invention showing the panels of the third embodiment being assembled.
Figure 15B:
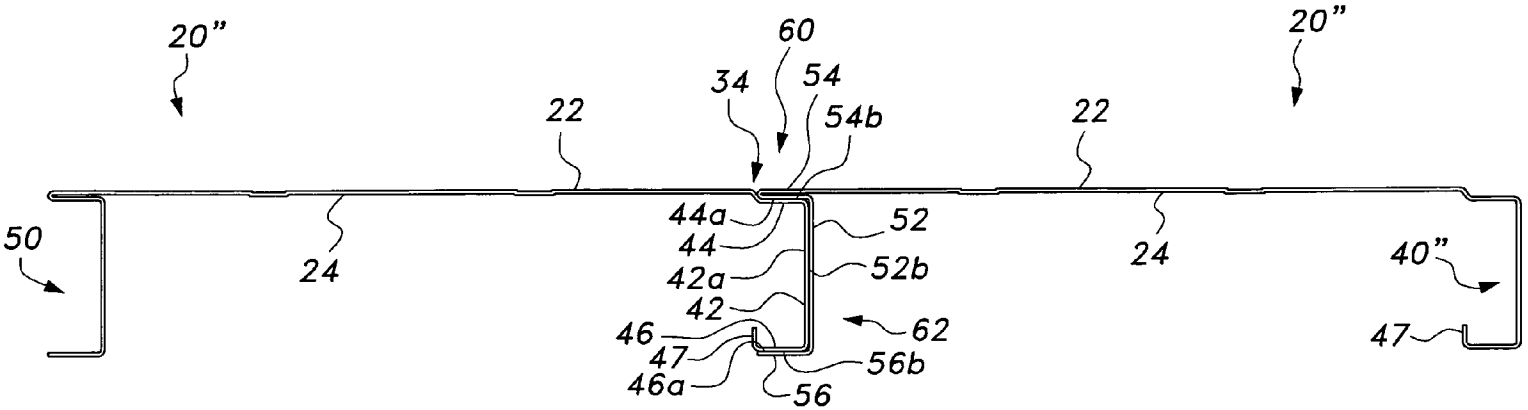

FIGS. 14, 15A and 15B depict a third embodiment of the invention that is substantially identical to the above-described embodiment of the universal structural steel panel 20 except that elongated male connecting member 40 has been modified to further increase the strength of panel 20. As described above, the universal structural steel panel 20 includes a generally elongated rectangular panel having an opposed exterior and interior surfaces 22, 24, an opposed first and second end portions 26, 28, and an opposed first and second side edge portions 30, 32. The first side edge portion 30 is fabricated with a beveled or tapered side edge portion 34. The panel 20 includes stiffening ribs 36 and 38, which are integrally formed and embedded to the panel 20 and extend longitudinally from first and second end portions 26, 28.

As further described above, the elongated male connecting member 40 is integrally connected to the first side edge portion 30 and the elongated female connecting member 50 is integrally connected to the second side edge portion 32. The elongated female connecting member 50 includes a web 52 and a first and second legs 54, 56 extending from opposite sides thereof. The elongated male connecting member 40 includes a web 42 and a first and second legs 44, 46 extending from opposite sides thereof. The first and second legs 44, 46 are in a generally parallel orientation with each other and have substantially similar length and width. The end portion of the first leg 44 is integrally connected to the beveled or tapered side edge portion 34 of the first side edge portion 30. The end portion of the first leg 54 is integrally connected to second side edge portion 32 and extends adjacent to the interior surface 24 to define a fold 60 thereof.

The webs 42 and 52 have an outer face 42*a*, 52*a* and an inner face 42*b*, 52*b*, respectively, and a plurality of apertures 48, 58 extending through the outer and inner faces 42*a*, 52*a*, and 42*b*, 52*b*.

Referring to FIG. 14, elongated male connecting member 40" includes a return lip 47 which perpendicularly extends along the length of leg 46. Return lip 47 has a width of about ⅜" to about ½" and is integrally formed as a 90 degree bend at the end portion of leg 46. Return lip 47 provides increased strength to panel 20".

Referring to FIGS. 15A and 15B, the elongated male connecting member 40" of panel 20" is cooperatively profiled to mate with the elongated female connecting member 50 of adjacent panel 20". The elongated male connecting member 40" is slidably interlocked into the elongate female connecting member 50 so that the outer face portion 42*a* of web 42 is in abutting relationship with inner face portion 52*b* of web 52 and the outer face portions 44*a*, 46*a* of legs 44, 46 are in abutting relationship with the inner face portions 54*b*, 56*b* of legs 54, 56, respectively. The adjoined elongated male connecting member 40" having the return lip 47 and the female connecting member 50 result in a structural component that is cable of withstanding heavy loads.

Figure 16:
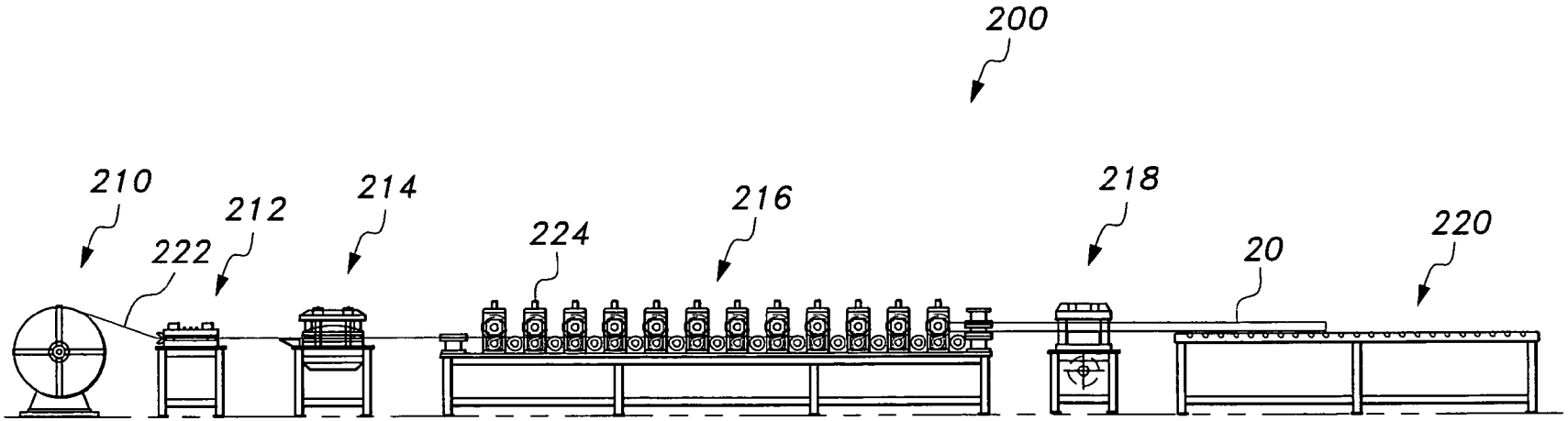
FIG. 16 is a schematic view of prefabricating a universal structural steel panel according to the present invention.

FIG. 16 shows the method of making the universal structural steel panels 20 according to the present invention. The panel fabricating system 200 for fabricating the universal structural steel panels 20 includes an uncoiler 210, a flattener and slitter 212, a pre-punch/press die 214, a roll former machine 216, a cut-off machine 218, and a run-out and discharge conveyor systems 220. The panel fabricating system 200 is automated and the plurality of rollers 224 are designed and configured to form the panel 20, as described above, from a substantially continuous sheet of steel.

In operation, steel 222 is uncoiled from a roll of steel by the uncoiler 210 and feed into the flattener and slitter apparatus 212 where the unrolled sheet of steel 222 is formed as a relatively flat sheet of steel and slotted at predetermined locations for punching holes. The sheet of steel is feed into the pre-punch/press die machine where the steel is punched to form holes/apertures 48, 58 and then stiffening ribs are pressed into the relatively flat sheet of steel for feeding into a roll former machine 216. The holes/apertures 48, 58 are generally oval shaped with a diameter of approximately 1 to 3 inches and a length of approximately 1 to 6 inches.

Next, the sheet of steel 222 is feed into the roll former machine 216 where a plurality of rollers 224 form and shape the panel 20 into its preferred embodiment, as described above. The panel 20 is then feed through the cut-off machine, where the panel 20 is cut at a predetermined length. The length of the panel 20 will vary depending on whether the panel is being fabricated for a wall 94, roof 150, or floor 130 component of the building. Accordingly, the panels 20 will have a general length of approximately 8 to 20 feet. For example, a typical wall length in the construction industry is 8 feet. Accordingly, the wall panel 20 will have a general length of 8 feet. The panel 20 is discharged from the panel fabricating system 200 by a run-out and discharge conveyor systems 220. The foregoing procedure is followed until a desired number of panels 20 are fabricated.

The steel used for making the panels 20 is preferably galvanized steel. More preferably, G-60 galvanized steel. The thickness of the sheet of steel 222 can vary depending on the load requirements of the building and the application of the panel 20. Generally, the steel 222 being rolled through the rollers 224 will have a thickness range from 12 to 30 gauges. The thickness of the panels 20 will depend on their application. For example, the panel 20 will have range in thickness from 26-gauge steel to 12-gauge steel depending on whether the panel 20 is used to construct the wall, floor, ceiling, or roof components of the building.

Although the invention has been described in language specific to structural features and/or methodological steps, it is to be understood that the invention defined in the appended claims is not necessarily limited to the specific features of steps described. Rather, the specific features and steps are disclosed as preferred forms of implementing the claimed invention

I claim:

1. A universal structural metallic panel system, comprising:

at least one elongated panel having opposing substantially planar exterior and interior surfaces, a first end portion and an opposing second end portion, wherein the first and second end portions are differently configured, and a first tapered side edge portion and an opposing second side edge portion;

the first end portion includes an elongated male connecting member having a web integrally connected directly with a first leg and a second leg extending from opposite sides thereof, the first leg being integrally connected directly to the first tapered side edge portion, wherein the web is connected directly to the end of the first leg and extends in a substantially perpendicular direction therefrom and terminates at the second leg, whereby the second leg extends parallel to the first leg;

the second end portion includes an elongated female connecting member having a web integrally connected directly with a first leg and a second leg extending from opposite sides thereof, wherein the web extends substantially perpendicular to each of the first and second legs, the first leg being integrally connected directly to the second side edge portion and extends adjacent the interior surface of said at least one elongated panel to define a fold, wherein the fold is defined solely by a first leg extending substantially interiorly, contiguous, and parallel to the second side edge portion and terminating at the web, and the second leg extends away from the web in a direction parallel to the first leg and in the same direction as the first leg of the male connecting member; and said elongated male connecting member of said at least one elongated panel cooperatively profiled to slidably interlock with said elongated female connecting member of an adjacent at least one elongated panel thereby being joined in a substantially continuous plane.

2. The universal structural steel panel system according to claim 1, wherein said at least one elongated panel is of a substantially rectangular shape.

3. The universal structural steel panel system according to claim 1, wherein said at least one elongated panel is constructed of galvanized steel.

4. The universal structural steel panel system according to claim 1, wherein said at least one elongated panel includes at least two stiffening ribs integrally embedded to said at least one elongated panel, said at least two stiffening ribs extending longitudinally from the first end portion to the second end portion.

5. The universal structural steel panel system according to claim 1, wherein the tapered first side edge portion is integrally connected to the first leg of said elongated male connecting member.

6. The universal structural steel panel system according to claim 1, wherein the second leg of said elongated male connecting member includes a return lip extending along its length.

7. The universal structural steel panel system according to claim 6, wherein said return lip is integrally formed as a 90 degree bend at the terminal end portion of the second leg.

8. A universal structural metallic panel system, comprising:

a plurality of elongated rectangular metallic panels, each of said elongated rectangular metallic panels including:

opposing exterior and interior surfaces, a first end portion and an opposing second end portion, wherein the first and second end portions are differently configured, and a first side tapered edge portion and an opposing second side edge portion;

the first end portion includes an elongated male connecting member having a web integrally connected directly with and extending between first and second legs extending substantially parallel to each other from opposing sides of the web, said elongated male connecting member integrally connected directly to the first tapered side edge portion of each of said plurality of rectangular steel panels;

the second end portion includes an elongated female connecting member having a web integrally connected directly with and extending between first and second legs extending substantially parallel to each other from opposing sides thereof, said elongated female connecting member integrally connected directly to the second side edge portion of each of said plurality of rectangular metallic panels, the first leg being integrally connected directly to the second side edge portion and extends adjacent the interior surface of said at least one elongated panel to define a fold, wherein the fold is defined solely by a first leg extending substantially interiorly, contiguous, and parallel to the second side edge portion and terminating at the web, and the second leg extends away from the web in a direction parallel to the first leg and in the same direction as the first leg of the male connecting member;

said elongated male connecting member of one of said plurality of elongated rectangular steel panels being cooperatively profiled to slidably interlock with said elongated female connecting member of an adjacent one of said plurality of elongated rectangular metallic panels, wherein said plurality of rectangular steel panels are joined together by interlocking said elongated male connecting member to said elongated female connecting member;

a first connecting member having a web portion and first and second legs, said first connecting member being connected directly to first end portions of said plurality of elongated rectangular metallic panels;

a second connecting member having a web portion and first and second legs, said second connecting member being connected directly to second end portions of said joined plurality of elongated rectangular metallic panels; and wherein said plurality of elongated panels define a building component for constructing a building.

9. The universal structural steel panel system according to claim 8, wherein said elongated male and female connecting members define a plurality of apertures, said plurality of apertures configured and arranged in alignment with respect to each other when said elongated male connecting member interlocks to said female connecting members.

10. The universal structural steel panel system according to claim 8, wherein said elongated rectangular metal panels includes an insulation material disposed on interior surface said plurality of elongated rectangular steel panels.

11. The universal structural steel panel system according to claim 8, wherein the first leg of said elongated female connecting member is integrally connected to the second side edge portion and extends adjacent the interior surface of each said rectangular metal panel to define a fold.

12. The universal structural steel panel system according to claim 8, wherein each of said plurality of elongated rectangular steel panels includes at least one stiffening rib embedded to exterior surface.

13. The universal structural steel panel system according to claim 8, wherein said elongated male and female connecting members define a beam having a substantially U-shaped.

14. The universal structural steel panel system according to claim 8, wherein said first and second connecting members are substantially U-shaped, said first and second connecting members having first and second legs fastened to the first and second legs of said elongated male and female connecting members.

15. The universal structural steel panel system according to claim 8, wherein the second leg of said elongated male connecting member includes a return lip extending along its length.

16. The universal structural steel panel system according to claim 15, wherein said return lip is integrally formed as a perpendicular bend at the terminal end portion of the second leg.

17. The universal structural steel panel system according to claim 8, wherein each of said plurality of elongated panels is constructed of galvanized steel.

* * * * *